US006019259A

United States Patent [19]

Staniecki

[11] Patent Number: 6,019,259

[45] Date of Patent: Feb. 1, 2000

[54] ATHLETIC GLOVE CONDITIONING SYSTEM

[76] Inventor: Joseph G. Staniecki, 287 Ave. C. #2B, New York, N.Y. 10009

[21] Appl. No.: 09/069,411

[22] Filed: Apr. 29, 1998

[51] Int. Cl.[7] ..... A41D 1/00

[52] U.S. Cl. ..... 223/80; 78/223; 78/78

[58] Field of Search ..... 223/78, 79, 80, 223/52; 254/199; 69/19.3, 19.2, 19.1, 19

[56] References Cited

U.S. PATENT DOCUMENTS

| | | | |
|---|---|---|---|
| 1,319,579 | 10/1919 | Gilliam | 223/78 |
| 2,436,121 | 2/1948 | Primus | 223/78 |
| 4,136,557 | 1/1979 | Bell, Jr. et al. | 223/61 |
| 4,199,089 | 4/1980 | Filkow et al. | 223/80 |
| 5,547,114 | 8/1996 | Mitchell | 223/78 |

FOREIGN PATENT DOCUMENTS

| | | | |
|---|---|---|---|
| 2209658 | 5/1989 | United Kingdom | 223/78 |

*Primary Examiner*—Bibhu Mohanty
*Attorney, Agent, or Firm*—Goldstein & Canino

[57] ABSTRACT

An athletic glove conditioning system comprising a hand member adapted to be fitted inside a new baseball or softball glove and a mechanical apparatus for causing a repetitive movement upon the glove while the hand member remains therein. The hand member includes a thumb piece pivotally connected to rest of the hand about a pivot axis selected to simulate the catching movement of a human hand, as when a baseball player is catching a ball with a glove. The mechanical apparatus has a pair of upwardly projecting arms provided with clamping devices for attaching to the thumb and finger portions of the glove. One of the arms is coupled to a drive mechanism to oscillate toward and away from the other arm. In use, the glove flexing apparatus causes the glove and the hand member therein to oscillate between open and closed positions, to simulate a repetitive flexing movement thereupon and thereby soften the leather along the appropriate places to permit better control by the user's hand.

5 Claims, 2 Drawing Sheets

ATHLETIC GLOVE CONDITIONING SYSTEM

BACKGROUND OF THE INVENTION

This invention relates to an athletic glove conditioning system. More particularly, the invention relates to a system which utilizes a hand member to be fitted inside a baseball or softball glove and a mechanical apparatus for effecting a repetitive flexing movement upon the athletic glove while the hand member remains therein.

Baseball gloves, softball gloves, and the like are often constructed of thick leather and one drawback to new leather athletic gloves is the amount of time and energy required for breaking them in since they are quite inflexible when newly purchased. Accordingly, in an attempt to solve the problems associated with breaking in of baseball gloves, several references uncovered in the prior art provide devices for shaping thereof to enhance the ability of the gloves to catch baseball or softball. For example, U.S. Pat. No. 5,547,114 to Mitchell discloses an apparatus for breaking in baseball gloves comprising a holder on which the glove can be mounted, and an air-operated impact member which is repeatedly caused to strike a palm part of the glove to soften the leather at the palm part. Likewise, U.S. Pat. No. 5,421,493 to Ebeling discloses a tool for breaking in baseball gloves that includes a head portion for pounding into the glove pocket and a handle portion for holding the tool.

While these units mentioned above may be suitable for the particular purpose employed, or for general use, they would not be as suitable for the purposes of the present invention as disclosed hereafter.

SUMMARY OF THE INVENTION

It is an object of the invention to provide an athletic glove conditioning system which enables a user to break-in a baseball or softball glove in a less amount of time than would be required if the glove was broken-in manually.

It is another object of the invention to provide an athletic glove conditioning system which effects a repetitive flexing action upon a baseball and softball glove to soften the leather at appropriate places and to permit better control by the user's hand.

It is yet another object of the invention to provide a hand member which is constructed to simulate the flexing movement of a human hand, as when a baseball player is catching a baseball with an athletic glove.

It is a further object of the invention to provide a mechanical apparatus with oscillating arms, which when properly attached to an athletic glove, causes the glove to repetitively move between open and closed positions.

The invention is an athletic glove conditioning system comprising a hand member adapted to be fitted inside a new baseball or softball glove and a mechanical apparatus for causing a repetitive movement upon the glove while the hand member remains therein. The hand member includes a thumb piece pivotally connected to rest of the hand about a pivot axis selected to simulate the catching movement of a human hand, as when a baseball player is catching a ball with a glove. The mechanical apparatus has a pair of upwardly projecting arms provided with clamping devices for attaching to the thumb and finger portions of the glove. One of the arms is coupled to a drive mechanism to oscillate toward and away from the other arm. In use, the glove flexing apparatus causes the glove and the hand member therein to oscillate between open and closed positions, to simulate a repetitive flexing movement thereupon and thereby soften the leather along the appropriate places to permit better control by the user's hand.

To the accomplishment of the above and related objects, the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
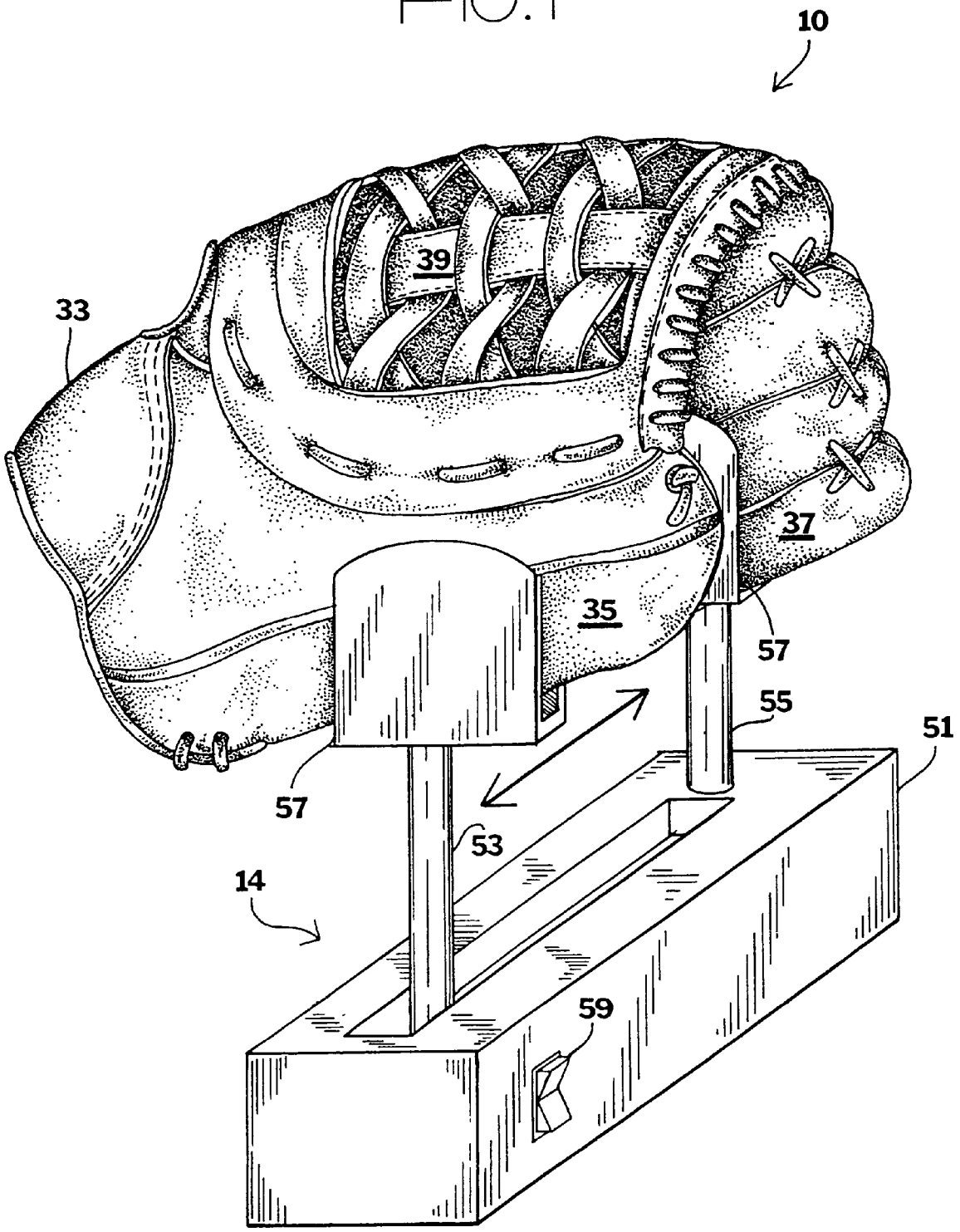
FIG. 1 is a diagrammatic perspective view of an athletic glove conditioning system in accordance with the principles of the present invention being used to break in a new baseball glove.

FIG. 1 illustrates a preferred embodiment of an athletic glove conditioning system 10 in accordance with the principles of the present invention. For a better understanding of the present invention, a baseball glove 33 is illustrated comprising a thumb portion 35, a finger portion 37, and a web 39 extending between the thumb and finger portions, a palm portion, and an opening for insertion of the user's hand. As will be seen in following paragraphs, the present invention is designed to effect a repetitive flexing action upon the baseball glove 33 to soften the leather at appropriate places and permit better control by the user's hand.

Figure 2:
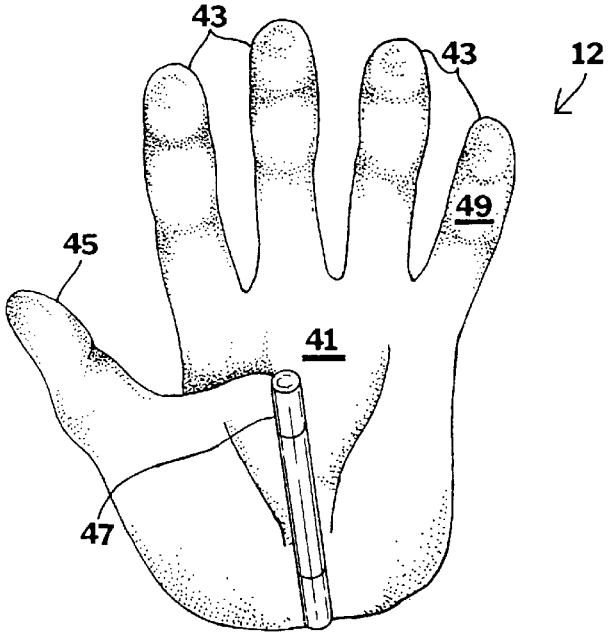
FIG. 2 is a diagrammatic perspective view of a preferred embodiment of a hand member of the present invention in an open position.
Figure 3:
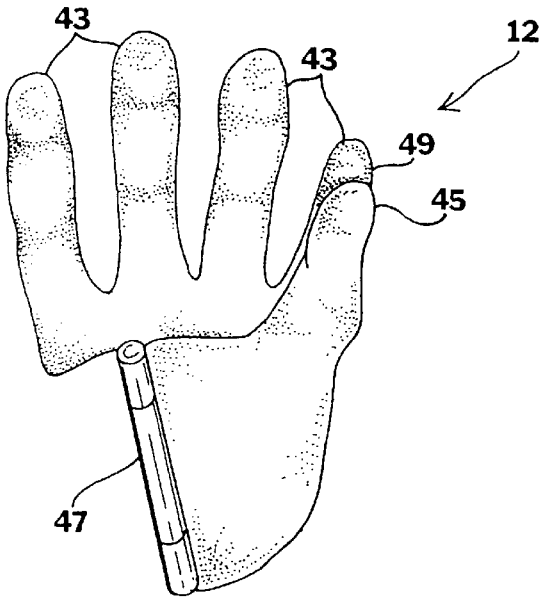
FIG. 3 is a diagrammatic perspective view of the preferred embodiment of the hand member in a closed position.

FIGS. 2 and 3 illustrate a hand member 12 adapted to be fitted inside the baseball glove 33 for simulating the flexing movement of a human hand. The hand member 12 is defined by a palm piece 41, a plurality of finger pieces 43 extending from the palm piece 41, and a thumb piece 45 pivotally connected to the palm piece 41 about a pivot axis 47. The hand member 12 can be constructed of a rigid plastic, or hard rubber material, or any other suitable material as would be appreciated by those skilled in the art. The hand member 12 is sized and shaped to simulate a human hand with its thumb and fingers slightly curled up, as when the human hand is placed inside the glove. Because baseball and softball gloves are available in different sizes, it may be necessary to manufacture the hand member in various sizes to conform to the different glove sizes. The thumb 45 and finger 43 pieces may be configured slightly longer than the length of human fingers to enhance flexing movement of the baseball glove 33. The pivot axis 47, about which the thumb piece 45 rotates with respect to the palm piece 41, is selected to simulate the flexing movement of a human hand, as when a baseball player is catching a baseball with an athletic glove. As seen by referring to FIG. 3, in the preferred embodiment of the hand member, the pivot axis 47 is selected to allow movement between an open position wherein the thumb piece is pivoted outwardly, as depicted in FIG. 2, and a closed position wherein the thumb piece 47 is pivoted inwardly and situated adjacent to the little finger 49, as depicted in FIG. 3.

Pursuant to the invention and as shown in FIG. 1, the glove conditioning system 10 employs a glove flexing apparatus 14 to effect a repetitive opening and closing movements upon the athletic glove 33. The glove flexing apparatus 14 includes a housing 51 for containing an electric motor, and first 53 and second 55 arms projecting upwardly from the housing 51. The upwardly projecting arms 53 and 55 are provided with suitable clamping devices 57 for releasably attaching to the thumb 35 and finger 37 portions of the baseball glove 33. The first upwardly projecting arm 55 is fixedly secured to the housing 51 and the second upwardly projecting arm 53 is coupled to a drive mechanism and is moveable between a retracted position wherein the first and second arms are aligned immediately adjacent to each other, and an extended position wherein the two arms are spread apart from each other.

The oscillating means for moving the second arm between the extended and retracted positions may be carried out in a number of ways. For example, a drive mechanism of a suitable type can be operatively coupled between the motor and the second arm 53 adapted to apply a drive from the electric motor to oscillate the second arm in a horizontal direction between the extended and retracted positions. The drive mechanism of the present invention is preferably of the type well known to persons of ordinary skill in the art and forms no part of the present invention. The electric motor can be powered by a suitable power source such as portable batteries, or together with suitable transformer device, a 120 volt household power source. A switch 59 is provided on the housing for manually operating the glove flexing apparatus 14 on and off. The apparatus 14 also includes electrical conductors to electrically connect the motor, the power source, and the switch in series whereby the motor is energized by the power source under the control of the switch to move the second upwardly projecting arm 53 repetitively toward and away from the first upwardly projecting arm 55. The glove flexing apparatus 14 may also include a control unit of any suitable type to allow a user to manually select the speed at which the second arm is to be oscillated.

The operation of the athletic glove conditioning system 10 will now be described. The hand member 12 is first inserted into the baseball glove 33 through the opening provided therein and is secured thereabout by means clamps 57, friction, or any other fastening means as would be appreciated by those skilled in the art. The baseball glove 33 is then attached to the glove flexing apparatus 14 to cause a repetitive movement between open and closed positions while the hand member 12 remains therein. One of the arms projecting from the glove flexing apparatus 14 is attached to the thumb portion 35 of the glove by adjusting the clamping device 57, and in a similar fashion, the other arm is attached to the finger portion 37 of the glove. The activation of the glove flexing apparatus 14 will cause the baseball glove 33 and the hand member 12 to oscillate between open and closed positions, to simulate a repetitive flexing movement thereupon, as when a baseball player is catching a ball with the glove. When constructed in accordance with the teachings of the present invention, the athletic glove conditioning system 10 will soften the leather along the appropriate places to enhance the glove's ability to catch a baseball and in a less amount of time as would have taken if the glove was broken in manually. After the baseball glove has been properly broken in, the hand member 12 can be placed inside the glove 33 in order to preserve its shape, when it is not being used.

While the embodiments of the present invention are disclosed in relation to baseball gloves, it should be noted that the athletic glove conditioning system disclosed herein can be used to break in softball gloves. Many specific details contained in the above description merely illustrate some preferred embodiments and should not be construed as a limitation on the scope of the invention. Many other variations are possible.

What is claimed is:

1. An athletic glove conditioning system for breaking in a baseball and softball glove, comprising:

a) a hand member to be fitted inside said glove, said hand member including a palm piece, a plurality finger pieces extending from said palm piece, and a thumb piece pivotally connected to said palm piece about a pivot axis, one of said finger pieces situated opposite to said thumb piece being a little finger, said hand member moveable between an open position wherein said thumb piece is rotated outwardly and a closed position wherein said thumb piece is rotated inwardly; and b) flexing means for flexing said glove and said hand member between open and closed positions while said hand member is placed inside said glove.

2. The athletic glove conditioning system as recited in claim 1, wherein the pivot axis of the hand member is configured to allow the thumb piece to rotate toward the little finger as the hand member is moving toward the closed position.

3. The athletic glove conditioning system as recited in claim 2, wherein the glove has thumb and finger portions, and wherein the flexing means comprises:

a) a housing containing an electric motor;

b) a first arm fixedly attached to said housing;

c) a second arm movable between a retracted position wherein said first and second arms are aligned immediately adjacent to each other, and an extended position wherein the two arms are spread apart from each other;

d) clamping means provided at the ends of said arms for releasably attaching to said thumb and finger portions of said athletic glove; and e) oscillating means located in said housing adapted to apply a drive from said electric motor to oscillate said second arm between said extended and retracted positions.

4. The athletic glove conditioning system as recited in claim 2, wherein the hand member is shaped and sized to simulate shape and size of a human hand for which the glove is intended.

5. The athletic glove conditioning system as recited in claim 2, wherein the thumb and finger pieces of the hand member have length which is longer than the length of normal human fingers to enhance flexing movement of the athletic glove.

* * * * *